US010054907B2

(12) United States Patent
Gruenig

(10) Patent No.: US 10,054,907 B2
(45) Date of Patent: Aug. 21, 2018

(54) TIMEPIECE MOVEMENT INCLUDING AN ANALOGUE DISPLAY

(71) Applicant: ETA SA Manufacture Horlogere Suisse, Grenchen (CH)

(72) Inventor: Daniel Gruenig, Sugiez (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 24 days.

(21) Appl. No.: 15/399,204

(22) Filed: Jan. 5, 2017

(65) Prior Publication Data

US 2017/0205769 A1 Jul. 20, 2017

(30) Foreign Application Priority Data

Jan. 18, 2016 (EP) ..... 16151735

(51) Int. Cl.
*G04B 19/24* (2006.01)
*G04C 17/00* (2006.01)
(Continued)

(52) U.S. Cl.
CPC ..... *G04B 31/02* (2013.01); *G04B 19/243* (2013.01); *G04B 19/247* (2013.01);
(Continued)

(58) Field of Classification Search
CPC ..... G04B 19/243; G04B 19/247; G04B 19/24306; G04B 19/253; G04C 17/0058; G04C 17/0066
See application file for complete search history.

(56) References Cited

U.S. PATENT DOCUMENTS 3,672,156 A * 6/1972 Miyasaka ..... G04B 13/002 368/38
3,704,583 A * 12/1972 Dome ..... G04B 19/25353 368/37
(Continued)

FOREIGN PATENT DOCUMENTS

EP 2 919 076 A1 9/2015
EP 2 927 756 A1 10/2015

OTHER PUBLICATIONS

European Search Report dated Jul. 21, 2016 in European Application 16151735.4, filed on Jan. 18, 2016 (with Translation of Categories of cited documents).

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

The timepiece movement is provided with an analog display device for an item of information whose value varies periodically or intermittently, this analog display device including an indicator for said information provided with a toothing and a mechanism for the periodic or intermittent driving of the indicator, this mechanism comprising a rotating wheel set whose pinion, in a meshing relationship with the toothing, is formed of two pins which are diametrically opposite relative to the rotational axis of the rotating wheel set, these two pins being configured to alternately penetrate successive hollows in the toothing and to form a self-locking system when the timepiece movement is subjected to shocks. Each of the two pins has, in a general plane of the toothing perpendicular to the axis of rotation of the rotating wheel set, a transverse profile having a first outer portion substantially in the arc of a circle centered on the axis of rotation.

18 Claims, 3 Drawing Sheets

(51) Int. Cl.

| | |
|---|---|
| ***G04B 31/02*** | (2006.01) |
| ***G04B 19/253*** | (2006.01) |
| ***G04B 19/247*** | (2006.01) |
| ***G04B 19/243*** | (2006.01) |

(52) U.S. Cl.
CPC ..... *G04B 19/24306* (2013.01); *G04B 19/253* (2013.01); *G04C 17/0058* (2013.01); *G04C 17/0066* (2013.01)

(56) References Cited

U.S. PATENT DOCUMENTS

| | | | | |
|---|---|---|---|---|
| 3,738,097 | A * | 6/1973 | Vuilleumier ..... | G04B 19/25366 368/37 |
| 4,427,300 | A * | 1/1984 | Groothuis ..... | G04B 27/005 368/28 |
| 5,187,693 | A * | 2/1993 | Besson ..... | G04C 17/0066 368/28 |
| 5,357,489 | A * | 10/1994 | Luthier ..... | G04C 3/12 310/323.02 |
| 6,185,158 | B1 | 2/2001 | Ito et al. | |
| 2006/0285444 | A1 * | 12/2006 | Burkhardt ..... | G04B 19/247 368/37 |
| 2015/0253732 | A1 | 9/2015 | Wyssbrod et al. | |
| 2015/0286189 | A1 | 10/2015 | Gruenig et al. | |
| 2016/0274542 | A1 * | 9/2016 | Gruenig ..... | G04B 19/253 |

* cited by examiner

TIMEPIECE MOVEMENT INCLUDING AN ANALOGUE DISPLAY

This application claims priority from European Patent Application No 16151735.4 of Jan. 18, 2016, the entire disclosure of which is hereby incorporated herein by reference.

FIELD OF THE INVENTION

The invention concerns the field of timepiece movements having an analogue display. It concerns, in particular, the shock resistance of a mechanism driving an analogue indicator, particularly a disc bearing calendar data and in particular a date ring. The invention concerns firstly electromechanical movements provided with an electromagnetic motor as the drive source for the analogue indicator drive mechanism. However, it may also be applied to purely mechanical movements.

In particular, the invention finds a specific application in an electromechanical movement having two analogue indicators driven by the same single motor and arranged such that at least one of the two indicators can be actuated to display its function without the other indicator being driven.

BACKGROUND OF THE INVENTION

In most known date display devices, the positioning of the date ring in the successive display positions is generally ensured by a jumper spring associated with the date ring toothing. Conventional drive systems do not ensure sufficient retention of the date ring in the event of shocks and therefore generally any locking. Thus, it is the jumper spring that has to ensure this locking function, which is why it has a high elastic constant. It will be noted that, to overcome the elastic force of the jumper spring, a high torque must be provided at the date ring.

However, to overcome the problem of the positioning jumper spring also having an anti-shock function, EP Patent Application 2927756 proposed a date ring drive mechanism including an irreversible transmission system capable of ensuring the anti-shock function while the positioning of the date ring is still ensured by a jumper spring, which then has a lower elastic constant. This document proposes, in particular, one embodiment with a pinion formed of two diametrically opposite pins relative to the axis of rotation of the pinion. In this document, a large play is provided between the pin and the ring toothing to ensure interference-free driving, particularly without locking. As the positioning jumper spring holds or returns the ring in or to a position where the axis of rotation of the pinion substantially intercepts the central axis of the tooth inserted between the pins, the pins penetrate the hollows of the toothing without risk of locking. To ensure this function, the pins are even truncated on the side of the rotational axis. It will be noted that the toothing has hollows with sides that close towards the bottom of the toothing. One problem with the embodiment represented in FIGS. 3A and 3B of EP Patent Application 2927756 arises from the fact that the pins have a small diameter and are also truncated, so that they are fragile and risk being damaged, and especially bent in the event of shocks. Further, this embodiment requires a positioning jumper spring, which increases the size of the date display device and also the cost of the timepiece movement.

Moreover, there is known from U.S. Pat. No. 6,185,158 an electronic watch fitted with an analogue display for several time parameters, in particular the hours, minutes and seconds, by means of three coaxial hands located at the centre of the watch dial. Further, the analogue display includes a chronograph hand, in particular a minute hand for the measured time interval, associated with a circular graduation over 360°, and a date display utilising a date ring, the displayed date appearing in conventional manner through an aperture in the dial. This Patent proposes to actuate the mechanism driving the chronograph hand (hereafter the "first mechanism") and the mechanism driving the date ring (hereafter the "second mechanism") via the same single electromechanical motor.

The first mechanism includes an intermediate wheel driven directly by the rotor of the motor and a chronograph wheel that meshes with the intermediate wheel. The second mechanism also includes said intermediate wheel and also an auxiliary wheel meshing with said intermediate wheel. The auxiliary wheel is integral with a wheel set that periodically actuates a wheel driving the date ring, this wheel set having a finger for actuating the drive wheel. The periodic actuation wheel set and the drive wheel together form a Geneva mechanism, known for periodically driving a date ring/disc. On each rotation of the periodic actuation wheel set, the finger drives the date ring drive wheel, which is driven in rotation over an angular distance corresponding to the change from one date to the next in the aperture in the dial provided for the date display. The Geneva mechanism is thus characterized by the periodic driving of the date ring drive wheel, with the periodic actuation wheel set only meshing with the drive wheel over an angular sector of less than 360°, whereas the wheel set locks the drive wheel on the remaining angular sector. Thus, although the periodic actuation wheel set rotates when positioned in the remaining angular sector, the rotational motion of the rotor is not transmitted to the date ring.

U.S. Pat. No. 6,185,158 uses the Geneva mechanism to enable the motor used for driving the date mechanism to perform an additional function, namely driving a chronograph hand. In short, the method consists in driving the chronograph hand when said periodic actuation wheel set is in its area of non-actuation, i.e. in said remaining angular sector, and, at the end of the measured time interval, in performing a reverse reset to return the periodic actuation wheel set to a predefined initial position.

The Geneva mechanism or a similar Maltese cross mechanism are relatively complex for the driving of a date ring. They require low tolerances for such a mechanism to be efficient and there is a risk of locking. Moreover, they are relatively bulky.

SUMMARY OF THE INVENTION

It is a first object of the invention to propose a timepiece movement equipped with an analogue display device for an item of information whose value varies periodically or intermittently, and wherein the periodic or intermittent drive mechanism for the indicator of this display device is relatively inexpensive, simple to assemble and limits the space required inside the timepiece movement, while providing an anti-shock function and proper positioning of the indicator in the plurality of discrete positions of the analogue display device.

"Periodic driving" means driving that occurs only periodically, that is to say the driving occurs periodically during a limited time interval and that no driving occurs between the limited time intervals. Likewise, "intermittent driving" means discontinuous driving which stops and starts according to the command of the intermittent drive mechanism without the driving necessarily occurring at regular intervals.

It is a second object of the invention to provide a timepiece movement that satisfies the aforementioned first object and wherein said drive mechanism allows the efficient positioning of the indicator in a plurality of discrete positions without requiring a jumper spring, in particular ensuring such positioning over a certain angular range of a rotating wheel set actuating the indicator, so as to allow a certain tolerance in the assembly of this rotating wheel set relative to its initial angular position and also to ensure proper positioning of the indicator even in case of missed steps during actuation of the drive mechanism by a stepping motor causing a variation in the angular position of the rotating wheel set in its rest positions.

It is a third object of the invention to provide a timepiece movement that satisfies the second aforementioned object and wherein said rotating wheel set has at least a certain dead angle for driving the aforementioned display device indicator, the anti-shock function and the positioning of the indicator being ensured during a rotation of the rotating wheel set in the dead angle zone defined by this dead angle. Such a timepiece movement allows a fourth object of the invention to be satisfied, consisting in arranging a second analogue display, comprising a second indicator kinematically connected to said drive mechanism, such that the second indicator is driven by the drive mechanism to indicate a second item of information, while the rotating wheel set remains in the dead angle zone.

These various objects are achieved by a timepiece movement provided with an analogue display device for an item of information whose value varies periodically or intermittently, this analogue display device including an indicator for said information provided with a toothing and a mechanism for the periodic or intermittent driving of the indicator, this mechanism comprising a rotating wheel set whose pinion, in a meshing relationship with the indicator toothing, is formed of two pins which are diametrically opposite relative to the rotational axis of the pinion, these two pins being configured to alternately penetrate successive hollows in the toothing and to form a self-locking system if the timepiece movement is subjected to shocks, at least when the pinion is in either of the two tangential positions where the two pins are oriented substantially tangentially to the toothing. In a general plane of the toothing perpendicular to the axis of rotation of the rotating wheel set, each of the two pins has a transverse profile having a first outer portion which is substantially in the arc of a circle centred on the axis of rotation of the rotating wheel set. In a particular embodiment, the two pins of the pinion are configured with respect to the indicator toothing such that there is a dead angle ($\alpha$) for driving the indicator via the pinion in at least one direction of rotation from each of the two tangential positions of the pinion, the dead angle being in a first variant substantially equal to or greater than fifteen degrees ($15° =< \alpha$), and in a second advantageous variant substantially equal to or greater than twenty-five degrees ($25° =< \alpha$). In another variant, the arc of a circle of the transverse profile of the two pins extends over an angular distance substantially equal to or greater than the dead angle. In a preferred variant, the arc of a circle of the transverse profile of the two pins extends over an angular distance ($\beta$) comprised between 3/2 multiplied by the aforementioned dead angle and substantially two times said dead angle ($3\alpha/2<\beta<2\alpha$).

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
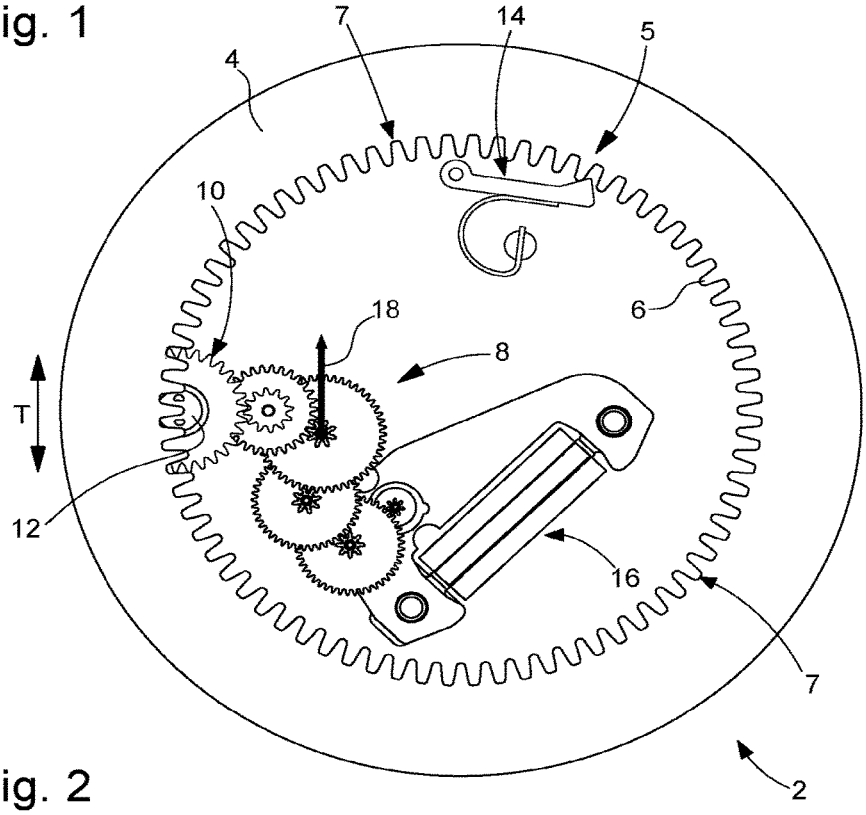
FIG. 1 represents an electromechanical movement, of the type of a main embodiment of the present invention, which implements a known pinion-pin for actuation of a date disc.
Figure 2:
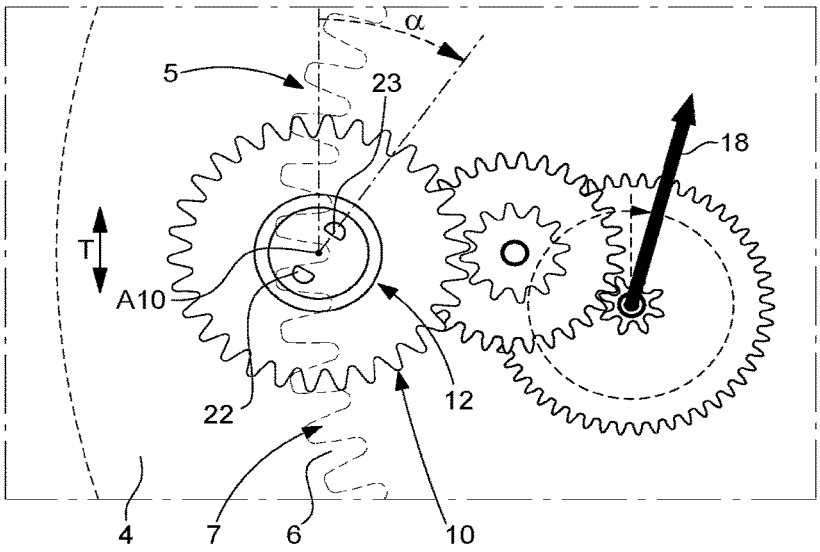
FIG. 2 is an enlarged partial view of FIG. 1.

Referring to FIGS. 1 and 2, there is described below an electromechanical movement 2 of the type of a main embodiment of the invention with the driving of a date ring via a known pin-pinion. This timepiece movement 2 includes a first display formed by a date ring 4 comprising an inner toothing 5, this ring being periodically driven (normally once per day) by a drive mechanism 8 which includes a rotating wheel set 10 whose pinion 12 meshes with toothing 5. This drive mechanism is actuated by a drive source which is formed by a bidirectional electrical motor 16 controlled by an electronic unit, in particular of the stepping type. Pinion 12 is formed of two pins 22 and 23 which, during the driving of ring 4, alternately penetrate successive hollows 7 in toothing 5. Pin-pinion 12 is characterized in that it forms with toothing 5, when the timepiece movement is subjected to shocks, a self-locking system for the date ring at least when the pinion is in either of the two tangential positions where the two pins are oriented substantially tangentially to circular toothing 5 (parallel to direction T).

To hold the date ring in a plurality of distinct positions in which it remains stationary during successive date display periods, a positioning jumper spring 14 is provided. This jumper spring is arranged to be stably inserted between two adjacent teeth of the toothing in each of the plurality of distinct positions of ring 4. This jumper spring is preferably sized to ensure precise positioning of ring 4, given the considerable play between the two pins 22, 23 and toothing 5 and also the relatively large dead angle $\alpha$ for pinion 12 on its rotation from its two tangential positions. However, the jumper spring is not provided here for an anti-shock function so that the elastic constant can be lower than in conventional devices.

Timepiece movement 2 further includes a second indicator 18 kinematically connected to mechanism 8 driving first indicator 4, this second display being arranged such that second indicator 18 can be driven by this drive mechanism to indicate a second item of information, in particular relating to a measured time interval, while rotating wheel set 10 remains in one or other of the two dead angle zones for driving the first indicator. Indeed, the two pins of pinion 12 are configured with respect to date ring toothing 5 such that there is a dead angle $\alpha$ for driving the indicator by the pinion in at least one direction of rotation from each of the two tangential positions of the pinion; the rotating wheel set thus does not drive the date ring in two dead angle zones defined within an angular marker connected to the timepiece movement and centred on the axis of rotation A10 of the rotating wheel set, these two dead angle zones comprising at least the dead angle indicated respectively from the two tangential positions of the pinion. As represented in FIG. 2, where pinion 12 is in an angular position located at the end of a dead angle zone, the second analogue display and its drive mechanism, which is formed here by part of the wheel sets of drive mechanism 8, are arranged such that second indicator 18 can make a rotation of at least 360° while the pinion is subjected to a rotation inside dead angle α from one of its two tangential positions. During actuation of indicator 18, there is a reset or periodic backward return of the indicator while the pinion remains angularly inside a dead angle zone. Two items of information can thus be displayed independently with a single drive mechanism and, in particular, a single electrical motor 16.

Figure 3:
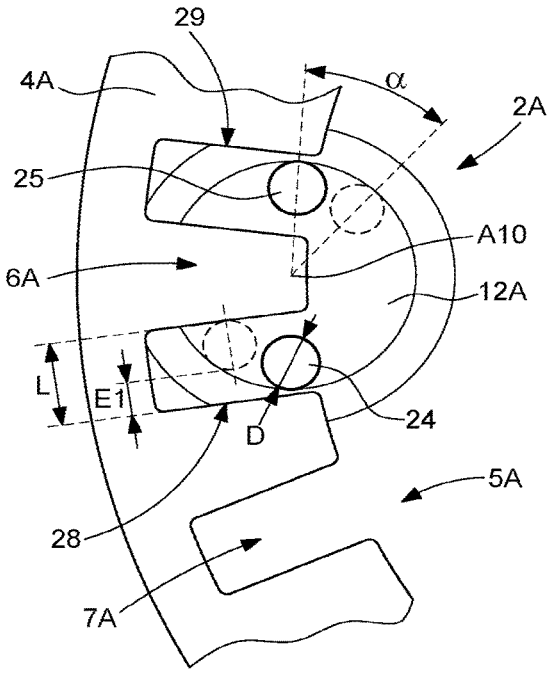
FIG. 3 shows a variant of the movement of FIG. 1 on the basis of which the issue at the heart of the present invention is explained in more detail.

Timepiece movement 2 has several advantages, particularly in relation to the driving of two indicators supplying independent items of information (date and measured time interval) by means of the same single drive source and with the anti-shock function obtained via a relatively simple, inexpensive system that is easy to mount inside the timepiece movement. However, this timepiece movement has some drawbacks. Firstly, the pins are relatively small. There is therefore a real risk of them being damaged when the timepiece movement is subjected to a shock, especially of them being permanently deformed by bending under the force exerted by the toothing on the pins during some shocks. Of course, the cross-section of the pins can be slightly increased, but this then reduces the dead angle zones. It is also possible to take a known toothing with hollows having parallel sides, as represented in FIG. 3, to increase the dead angle zones. However, even in that case, a positioning jumper is provided, which is cumbersome and requires a certain amount of energy on a change of date. Further, the anti-shock function loses efficiency when pinion 12 is located in the end region of a dead angle zone, so that in case of shocks in such a situation, it is not possible to ensure sufficient locking of the date ring.

FIG. 3 represents a variant of timepiece movement 2 wherein various parameters have been improved, starting from a similar configuration to that known in the prior art. Only pin-pinion 12A of the drive mechanism of timepiece movement 2A is represented, since the other parts are identical to those of timepiece movement 2. Pinion 12A includes two cylindrical pins 24 and 25 with a diameter D. The hollows 7A of toothing 5A of date ring 4A have a substantially rectangular profile and thus parallel sides (side walls). The width L of the hollows is approximately equal to the width of the teeth at mid-height. Diameter D of the pins is greater than half the width L of hollows 7A to ensure sufficient mechanical strength.

To obtain a maximum dead angle α for such a configuration, in the two aforementioned tangential positions, the pins are arranged to leave a relatively small play between the pins and the two teeth defining the outer sides 28 and 29 of two respective hollows facing the two pins, so that the date ring has a relatively small angular play when the pinion is in one or other of the two tangential positions. Thus, with the best adjustment of the dimensions of toothing 5A and of the pins, it would be possible to do without a positioning jumper in these two tangential positions, which is one of the objects of the invention. However, as can be seen in FIG. 3, when pinion 12A rotates in a dead angle zone, for example during the actuation of a second indicator, the angular play increases and as soon as the exiting pin is no longer in mesh with the toothing, this play becomes significant with a value E1 equal to the difference between width L of the hollows and the diameter of the pins. It is not therefore possible to do without a positioning jumper in movement 2A.

It will be noted that the pinion is generally arranged to be in one of its two tangential positions in the rest periods when neither the date ring nor the second indicator are driven. These rest positions are preferred since they ensure the best anti-shock protection. It will be noted that the locking torque exerted by the pinion immediately diminishes moving away from said rest positions. Finally, it will be noted that the preferred rest positions are not always those that occur in practice for various reasons; the first arising from the fact that pinion 12A can be initially mounted with an angular position having a certain variation, and the second from the fact that the motor may miss some steps so that the precise angular position of the pinion is not known. Consequently, even when the drive mechanism is inactive in rest periods, the positioning jumper provided in the prior art is required in order to overcome this problem. However, the invention efficiently overcomes these problems by proposing the solution that will be explained below.

Figure 4A:
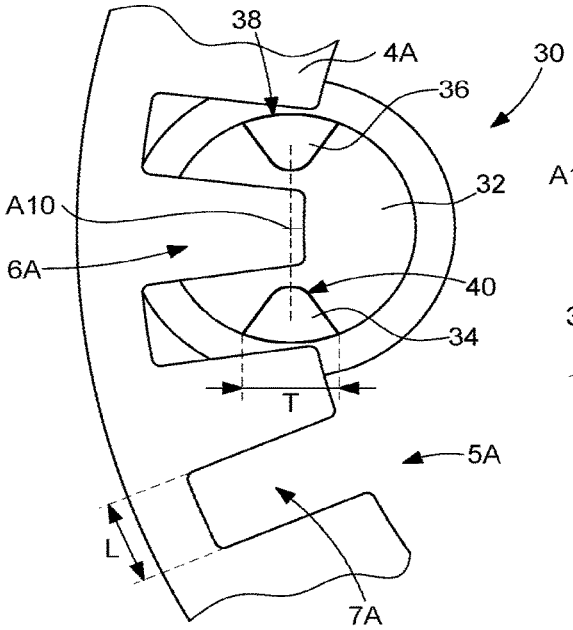
FIGS. 4A and 4B are partial views of a first embodiment of the invention.
Figure 4B:
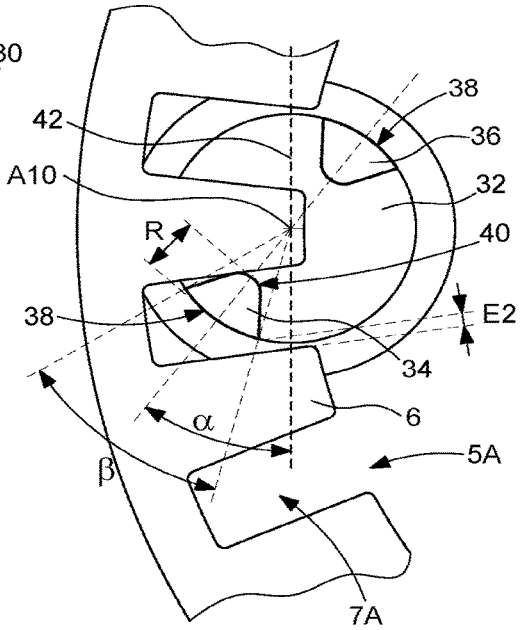

Referring to FIGS. 4A and 4B, a first embodiment of a timepiece movement 30 will be described. With the exception of pinion 32, the drive mechanism for date ring 4A and the latter are identical to those implemented in movement 2A of FIG. 3. They will not, therefore, be described again here. Pinion 32 includes two pins 34 and 36 which each have, in a general plane of toothing 5A perpendicular to axis of rotation A10 of the rotating wheel set including pinion 32, a transverse profile having a first outer portion 38 substantially in the arc of a circle, centred on the axis of rotation. The rear portion 40 of each pin is rounded and substantially corresponds to the rear portion of pins 24 and 25 of FIG. 3. Consequently, in the example represented, a circle having the diameter of pins 24 and 25 is inscribed within each pin 36, 38. These pins 36 and 38 are symmetrical relative to a plane comprising axis of rotation A10 and have the same behaviour regardless of the direction of rotation of pinion 32. The tangential length T of these pins, perpendicular to said plane of symmetry, is arranged to be greater than diameter D of pins 24, 25 and than radial dimension R of pins 36, 38. The outer, arc of a circle portion advantageously extends over the entire tangential length. It will be noted that, in order to drive ring 4A, tangential length T is smaller than the width L of hollows 7A.

In FIG. 4B, pinion 32 has been rotated by dead angle α; the date ring has remained in the same angular position during this rotation. It is observed firstly that the dead angle is substantially equal to that featured in the embodiment of FIG. 3. Generally speaking, the dead angle is arranged to be substantially equal to or greater than fifteen degrees ($15° = < \alpha$). It will be noted that in a preferred variant, the dead angle is substantially equal to or greater than twenty-five degrees ($25° = < \alpha$). Next, it is observed that the outer arc of a circle of the transverse profile of the two pins extends over an angular distance β which, in the example represented, is substantially equal to the dead angle. Preferably, in other variants, angular distance β is arranged to be greater than the dead angle. An immediate advantage of the invention is observed in FIG. 4B, namely that the maximum play E2 of a pin configured according to the invention is much smaller than the maximum play E1 of the embodiment of FIG. 3, while the play of pinion 32 in its two tangential positions, corresponding to the situation of FIG. 4A, is identical in the two timepiece movements 2A and 30. In an advantageous variant, the pinion and the toothing are arranged such that, when the pinion is in either of its two tangential positions, the calendar indicator has an angular play that is smaller than or substantially equal to thirty-five microns (35 μm). Further, in an initial portion of the dead angle zone defined by dead angle α, from the direction 42 tangent to circular toothing 5A, the angular play of the date ring does not vary. This is due to the fact that the arc of a circle 38 has a radius centred on axis of rotation A10 of pinion 32. It will be noted that this initial portion extends here over approximately half of angular distance β (corresponding in this example to the angular opening of the pins). By adjusting the profile of the end of the teeth, an even greater angular distance of rotation with constant play is possible. In an advantageous variant, the pinion and the toothing are arranged such that, when the rotating wheel set is subjected to a rotation over all of either one of the two dead angle zones, the date indicator has an angular play that remains less than or substantially equal to forty microns (40 μm).

Owing to the profile of the pins according to the invention, by providing a small play in the two tangential positions of the pinion, it is thus possible to obviate the positioning jumper while ensuring proper positioning of the date ring. Other advantages result from this invention. Firstly, for a width L of the hollows of toothing 5A, the pins are more solid than in the case of FIG. 3. They are therefore stronger and more resistant to shocks. Next, the dead angle and therefore the dead angle zone may still be considerably, notably as large as in an embodiment with conventional cylindrical pins. Finally, the anti-shock function is greatly improved since, in case of shocks, the points of application of the force of the date ring on the pins remains on a tangent intercepting axis of rotation A10 over the entire angular distance of rotation with constant play. Thus, not only in its two tangential positions, but over this entire angular distance, there is no torque exerted on pinion 32 in the event of external shocks causing an angular acceleration of the date ring.

Figure 5:
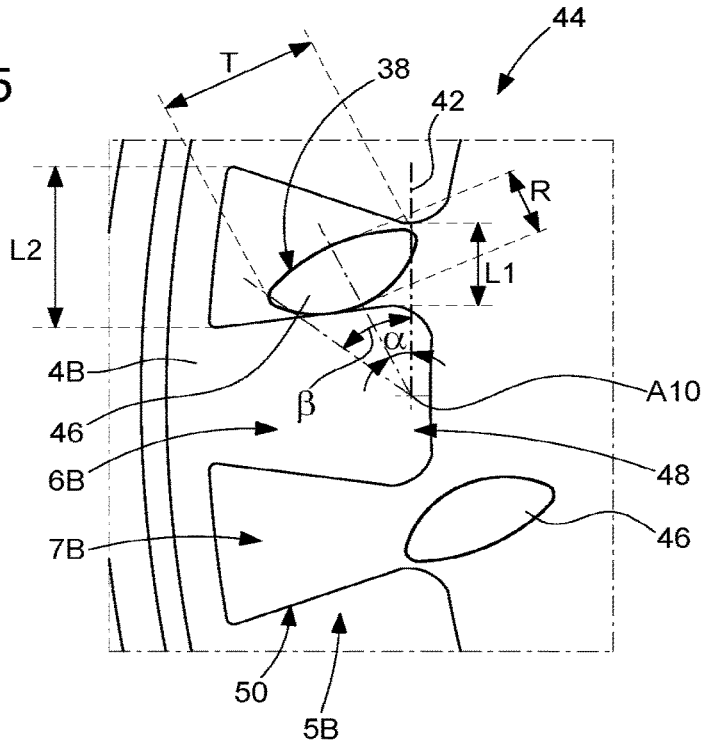
FIG. 5 is a partial top view of a second embodiment of the invention.
Figure 6:
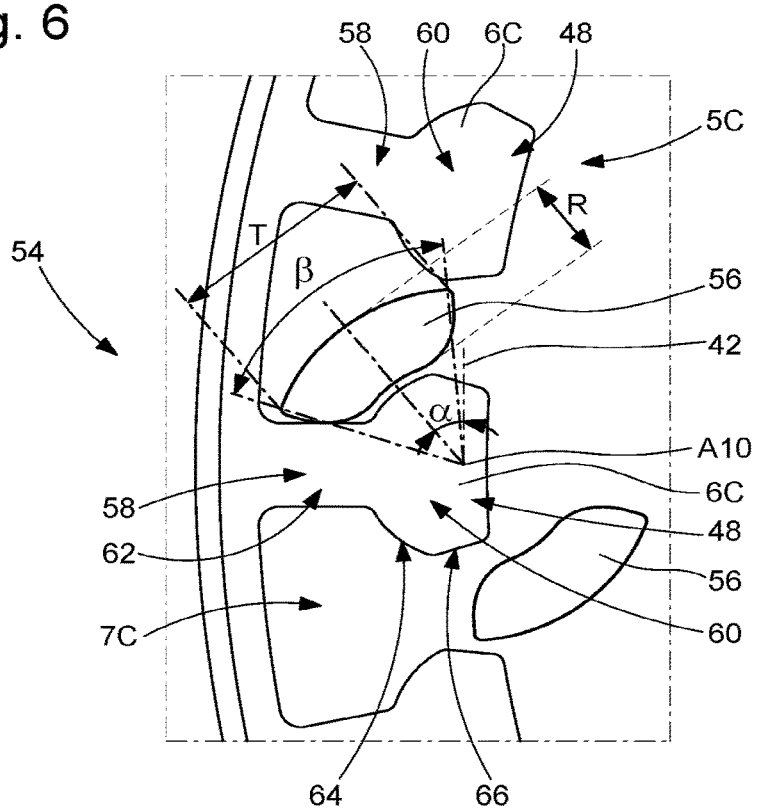
FIG. 6 is a sophisticated variant of the second embodiment.

Referring to FIGS. 5 and 6, two variants of a particular second embodiment will be described below, in which not only do the pins have a specific profile according to the invention, but also the toothing of the calendar indicator. In these two variants, the arc of a circle 38 of the transverse profile of the two pins extends over an angular distance β comprised between 3/2 multiplied by the dead angle α and substantially two times said dead angle ($3\alpha/2<\beta<2\alpha$). It will be noted that this arc of a circle is centred on axis of rotation A10 of the rotating wheel set which is formed by the two pins. Next, in these two variants, each hollow 7B, respectively 7C of toothing 5B, 5C exhibits, at ends 48 of two adjacent teeth 6B, 6C, an opening which has a dimension L1 smaller than the width of the hollow in the area of contact thereof with the two pins, during the driving of the calendar indicator by the rotating wheel set including these two pins, and notably smaller than the maximum width L2 at the bottom of the toothing. The aforementioned contact region extends over a certain distance along side walls 50, respectively 62 of the teeth, beyond tangent 42 to the circular toothing towards the bottom of the toothing.

Next, each pin 46, respectively 56 has a radial dimension R relative to axis of rotation A10 of the rotating wheel set and a tangential dimension T, perpendicular to the radial dimension, the value of this one tangential dimension being substantially equal to two times that of the radial dimension or greater. It will also be noted that dimension L1 is arranged to be greater than radial dimension R and dimension L2 is arranged to be greater than tangential dimension T, otherwise the meshing of the pinion-pin with the toothing of the calendar indicator cannot function since it will quickly lock.

In the variant of FIG. 5, the side profile 50 of teeth 6B, respectively of the side edges of hollows 7B, is substantially rectilinear from tangent 42 to the bottom of the toothing. Each hollow 7B is flared towards the bottom of the toothing and thus each tooth 6B is flared towards its end region 48. At the ends of the teeth, the profile of the teeth substantially follows an arc of a circle centred on axis A10. Pins 46 also have a flared shape moving away radially from axis of rotation A10. They have a large opening to considerably increase angular distance β of the arc of a circle defined by the outer portion of the tooth. Thus, a small substantially constant play is obtained for almost the entire dead angle distance, which extends approximately over dead angle α whose value is approximately equal to 30° for the example represented. Thus, in the event of an external shock, the two pins of the pinion lock the first indicator when the rotating wheel set is angularly within either of the two dead angle zones.

In the variant of FIG. 6, the inner portion of each of the two pins 56 also has an arc of a circle profile to allow tangential dimension T of the pins to be increased without thereby increasing their radial dimension R. This allows the angular opening of the pins to be increased and thereby the angular distance defined by the outer arc of a circle 38. Teeth 6C have a corresponding profile which is arranged to allow a greater dead angle to be obtained while having a substantially constant small play over the dead angle distance resulting from this dead angle. Each tooth has a root 58 with substantially parallel side walls 62. Next, the width of the teeth increases with a circular profile section 64 centred on axis A10, the radius of this circular profile being arranged to be slightly smaller than that defined by the inner circular portion of the pins. Finally, to facilitate the penetration of the pins inside the toothing and to prevent the gear locking, in their terminal end region, the teeth have a profile section 66 that curves towards axis A10 and enlarges the opening between the ends of two adjacent teeth. The length of section 66 may the relatively large here and extend beyond tangent 42 without adversely affecting the small play over the large dead angle distance which has a value of between 35° and 40° in the example represented.

In a similar manner to that explained above with reference to FIGS. 1 and 2, in the first and second embodiments, the information of each calendar indicator 4A, 4B and 4C, respectively represented in FIGS. 4, 5 and 6, is a first item of information. Thus, the analogue display is a first analogue display and the calendar indicator is a first indicator. Next, timepiece movement 44, respectively 54 of these two embodiments further comprises a second analogue display (not represented but similar to that of FIGS. 1 and 2) comprising a second indicator, which is kinematically connected to the mechanism driving the first indicator. This second display is arranged such that the second indicator is driven by the drive mechanism to indicate a second item of information independent of the first item of information while the rotating wheel set remains in one or other of the two dead angle zones defined by dead angle α from the two possible tangential positions of the pinion-pin.

What is claimed is:

1. A timepiece movement provided with an analogue display device for an item of information whose value varies periodically or intermittently, said analogue display device including an indicator for said information provided with a toothing and a mechanism for the periodic or intermittent driving of the indicator, said mechanism comprising a rotating wheel set whose pinion, in a meshing relationship with said toothing, is formed of two pins which are diametrically opposite relative to a rotational axis of the rotating wheel set, these two pins being configured to alternately penetrate successive hollows in said toothing and to form a self-locking system when the timepiece movement is subjected to shocks, at least when the pinion is in either of the two tangential positions where the two pins are oriented substantially tangentially to the indicator toothing, each of the two pins having, in a general plane of said toothing perpendicular to the axis of rotation of the rotating wheel set, a transverse profile having a first outer portion substantially in an arc of a circle centered on the axis of rotation, the two pins of said pinion being configured with respect to said indicator toothing such that there is a dead angle for the driving of said indicator by said pinion in at least one direction of rotation from each of said two tangential positions of the pinion, said rotating wheel set thus does not drive the indicator in two dead angle zones defined inside an angular marker connected to the timepiece movement and centered on the axis of rotation of the rotating wheel set, said two dead angle zones including at least said dead angle respectively from the two tangential positions of the pinion, the first outer portion of the transverse profile of the two pins extending over an angular distance substantially equal to or greater than said dead angle.

2. The timepiece movement according to claim 1, wherein said dead angle is substantially equal to or greater than fifteen degrees.

3. The timepiece movement according to claim 2, wherein the first outer portion of the transverse profile of the two pins extends over an angular distance comprised between 3/2 multiplied by said dead angle and substantially two times said dead angle.

4. The timepiece movement according to claim 3, wherein each hollow of said toothing has an opening, at ends of two adjacent teeth, having a dimension smaller than a width of said hollow in a region of contact thereof with the two pins during the driving of said indicator by the rotating wheel set.

5. The timepiece movement according to claim 4, wherein each pin has a radial dimension relative to the axis of rotation of said rotating wheel set and a tangential dimension, perpendicular to the radial dimension, whose value is substantially equal to two times that of the radial dimension or greater.

6. The timepiece movement according to claim 2, wherein said item of information is a first item of information, said analogue display is a first analogue display and said indicator is a first indicator, wherein said timepiece movement includes a second analogue display including a second indicator kinematically connected to said mechanism driving the first indicator, said second display being arranged such that the second indicator is driven by the mechanism for periodic or intermittent driving to indicate a second item of information, while the rotating wheel set remains in one or other of the two dead angle zones.

7. The timepiece movement according to claim 6, wherein, in the event of a shock, the two pins of said pinion lock said first indicator when the rotating wheel set is angularly within either of the two dead angle zones.

8. The timepiece movement according to claim 6, wherein the second analogue display and the mechanism for periodic or intermittent driving are arranged such that the second indicator can make a rotation of at least 360° while said pinion is subjected to a rotation inside said dead angle from either of its two tangential positions.

9. The timepiece movement according to claim 8, wherein the second analogue display is a display of a measured time interval.

10. The timepiece movement according to claim 6, wherein said indicator is a date ring.

11. The timepiece movement according to claim 6, wherein said pinion and said toothing are arranged such that, when the pinion is in either of its two tangential positions, said indicator has an angular play that is smaller than or substantially equal to thirty-five microns.

12. The timepiece movement according to claim 6, wherein said pinion and said toothing are arranged such that, when the rotating wheel set is subjected to a rotation over all of either one of the two dead angle zones, said indicator has an angular play that remains smaller than or substantially equal to forty microns.

13. The timepiece movement according to claim 6, wherein said mechanism for periodic or intermittent driving includes a drive source which is formed by a bidirectional electrical motor controlled by an electronic unit.

14. The timepiece movement according to claim 1, wherein said dead angle is substantially equal to or greater than twenty-five degrees.

15. The timepiece movement according to claim 1, wherein said indicator is a date ring.

16. The timepiece movement according to claim 1, wherein said pinion and said toothing are arranged such that, when the pinion is in either of its two tangential positions, said indicator has an angular play that is smaller than or substantially equal to thirty-five microns.

17. The timepiece movement according to claim 1, wherein said pinion and said toothing are arranged such that, when the rotating wheel set is subjected to a rotation over all of either one of the two dead angle zones, said indicator has an angular play that remains smaller than or substantially equal to forty microns.

18. The timepiece movement according to claim 1, wherein said mechanism for periodic or intermittent driving includes a drive source which is formed by a bidirectional electrical motor controlled by an electronic unit.

* * * * *